US006753485B1

(12) United States Patent
Tuniewicz

(10) Patent No.: US 6,753,485 B1
(45) Date of Patent: Jun. 22, 2004

(54) ROTARY SWITCH CONTAINING FUSE CAPABILITIES

(76) Inventor: Robert M. Tuniewicz, 14 Remsen Ct., Mt. Sinai, NY (US) 11766

( * ) Notice: Subject to any disclaimer, the term of this patent is extended or adjusted under 35 U.S.C. 154(b) by 0 days.

(21) Appl. No.: 10/425,472

(22) Filed: Apr. 29, 2003

(51) Int. Cl.[7] ..... H01H 21/16; H01H 85/00

(52) U.S. Cl. ..... 200/11 R; 200/50.01; 337/8; 337/10; 337/194; 337/201; 337/289

(58) Field of Search ..... 337/5, 6, 8, 10, 337/12, 143, 194, 201, 209, 214, 229, 230, 237, 259, 289; 200/11 A–11 TW, 336, 564–570, 50.01

(56) References Cited

U.S. PATENT DOCUMENTS 2,097,019 A * 10/1937 Clough ..... 200/11 J X
2,144,139 A * 1/1939 Batcheller ..... 337/143
2,692,309 A * 10/1954 Ellithorpe ..... 337/10 X
3,917,920 A * 11/1975 Pekrul et al. ..... 200/571
4,492,945 A * 1/1985 Jou et al. ..... 337/229

* cited by examiner

*Primary Examiner*—James R. Scott
(74) *Attorney, Agent, or Firm*—Richard L. Miller

(57) ABSTRACT

A rotary switch containing fuse capabilities. An electrical contact disc is rotatively mounted in a housing. A handle assembly is mounted to the electrical contact disc and rotates therewith, and is replaceably mounted in the housing so as to allow the handle assembly to be removed from the housing and prevent inadvertent operation of the rotary switch. A pin extends in the handle assembly and a fuse retainer and engages a horse shoe clip, and in doing so, axially movably attaches the fuse retainer to a fuse-holding disc. The pin then extends in a bushing. A pair of blind slots in the pin engage a hair pin clip, and in so doing, the handle assembly can rotate relative to, but cannot be removed from, the housing, unless the pin is rotated 90 degrees, which would orientate the pair of through slots out of engagement with the hair pin clip.

45 Claims, 5 Drawing Sheets

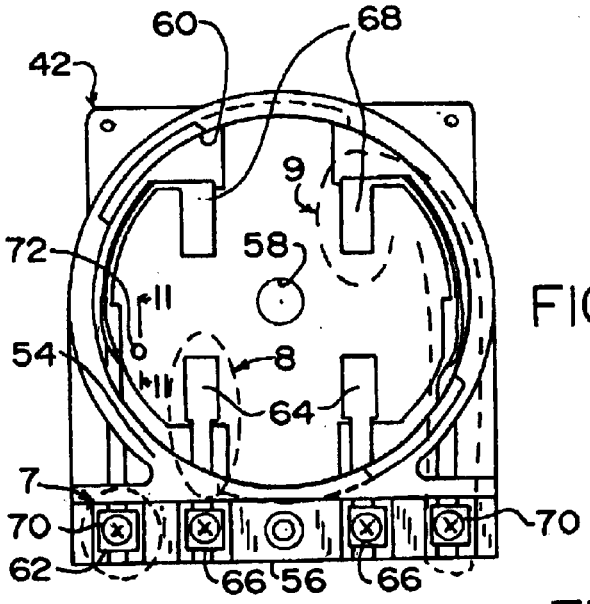
FIG. 6
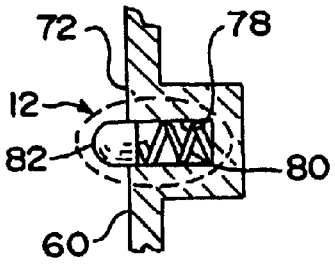
FIG. 11
FIG. 7
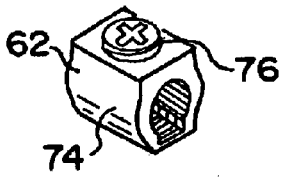
FIG. 8
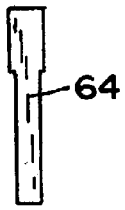
FIG. 9
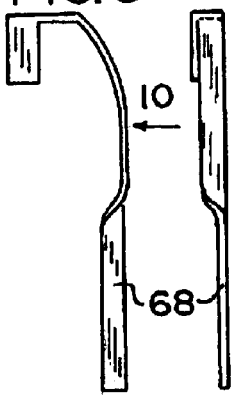
FIG. 10
FIG. 12
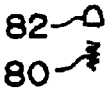
FIG. 14
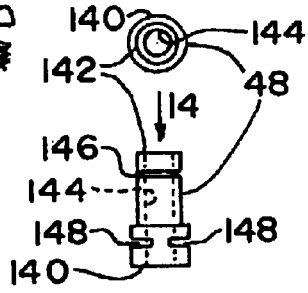
FIG. 13
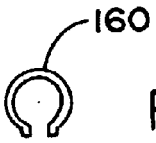
FIG. 33
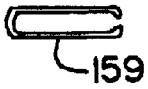
FIG. 34

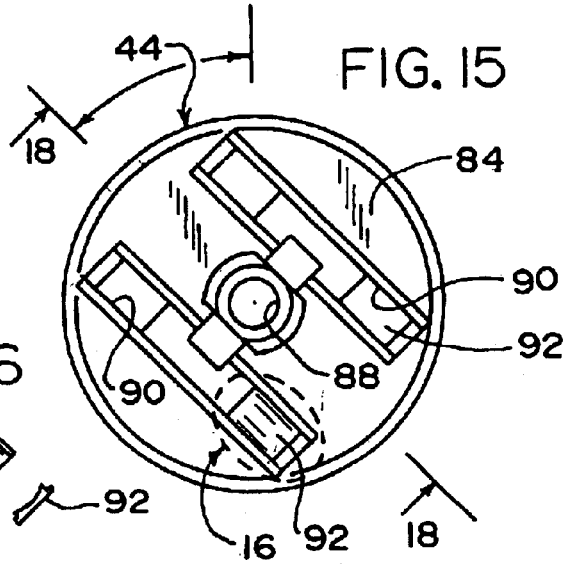
FIG. 15
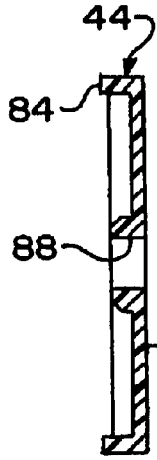
FIG. 18
FIG. 16
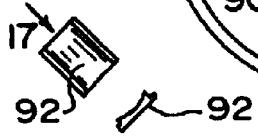
FIG. 17
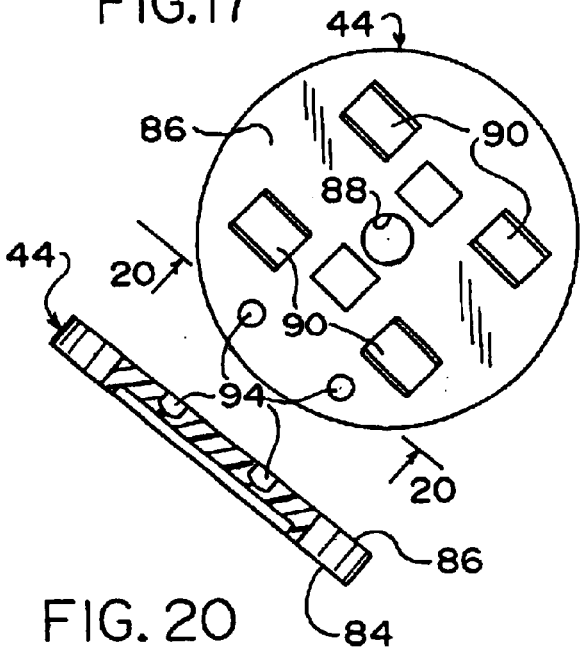
FIG. 19
FIG. 20

156
50
150
154
156
157
50

46
21A
104
96
98
100
22
30
25
108
110
106
102
104

96
100
101
103
119
106

122
124
128
23
126
124
130

21A
130
124
128
131
128
24
130

126
122
124
130

118
108
112
112
31
118
114
112
116
120
108

132
138
136
138
134
26
138

138
27

138
111

113
133

ROTARY SWITCH CONTAINING FUSE CAPABILITIES

BACKGROUND OF THE INVENTION

1. Field of the Invention

The present invention relates to a rotary switch. More particularly, the present invention relates to a rotary switch containing fuse capabilities.

2. Description of the Prior Art

Innovations for rotary switches have been provided in the prior art. Even though these innovations may be suitable for the specific individual purposes to which they address, however, they differ from the present invention in that they do not teach a rotary switch containing fuse capabilities.

SUMMARY OF THE INVENTION

Accordingly, an object of the present invention is to provide a rotary switch containing fuse capabilities that avoids the disadvantages of the prior art.

Another object of the present invention is to provide a rotary switch containing fuse capabilities that is simple to use.

Briefly stated, still another object of the present invention is to provide a rotary switch containing fuse capabilities. An electrical contact disc is rotatively mounted in a housing. A handle assembly is mounted to the electrical contact disc and rotates therewith, and is replaceably mounted in the housing so as to allow the handle assembly to be removed from the housing and prevent inadvertent operation of the rotary switch. A pin extends in the handle assembly and a fuse retainer and engages a horse shoe clip, and in doing so, axially movably attaches the fuse retainer to a fuse-holding disc. The pin then extends in a bushing. A pair of blind slots in the pin engage a hair pin clip, and in so doing, the handle assembly can rotate relative to, but cannot be removed from, the housing, unless the pin is rotated 90 degrees, which would orientate the pair of through slots out of engagement with the hair pin clip.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows;

FIG. 6 is an enlarged diagrammatic front view taken generally in the direction of arrow 8 in FIG. 5 of the housing of the present invention.

FIG. 7 is an enlarged diagrammatic perspective view of the area generally enclosed by the dotted curve identified by arrow 7 in FIG. 6 of an electrical wire-connecting terminal of the housing of the present invention;

FIG. 8 is an enlarged diagrammatic front view of the area generally enclosed by the dotted curve identified by arrow 8 in FIG. 6 of a proximal electrical contact of the housing of the present invention;

FIG. 9 is an enlarged diagrammatic front view of the area generally enclosed by the dotted curve identified by arrow 9 in FIG. 6 of a distal electrical contact of the housing of the present invention;

FIG. 10 is an enlarged diagrammatic side view taken generally in the direction of arrow 10 in FIG. 9;

FIG. 11 is an enlarged diagrammatic cross sectional view taken along line 11—11 of the detent pin assembly of the housing of the present invention;

FIG. 12 is a reduced exploded diagrammatic side view of the area generally enclosed by the dotted curve identified by arrow 12 in FIG. 11;

FIG. 13 is a diagrammatic side view taken generally in the direction of arrow 13 in FIG. 5 of the pin-receiving bushing of the present invention;

FIG. 14 is a diagrammatic top plan view taken generally in the direction of arrow 14 in FIG. 13;

FIG. 15 is an enlarged diagrammatic front view generally in the direction of arrow 15 in FIG. 5 of the electrical contact disc of the present invention;

FIG. 16 is a diagrammatic top plan view of the area generally enclosed by the dotted curve identified by arrow 16 in FIG. 15 and FIG. 5 of an electrical contact of the electrical contact disc of the present invention;

FIG. 17 is a diagrammatic end view taken generally in the direction of arrow 17 in FIG. 18;

FIG. 18 is a diagrammatic cross sectional view taken along line 18–18 in FIG. 15;

FIG. 19 is a diagrammatic rear view taken generally in the direction of arrow 19 in FIG. 18 and FIG. 5;

FIG. 20 is a diagrammatic cross sectional view taken along line 20—20 in FIG. 19;

Figure 3:
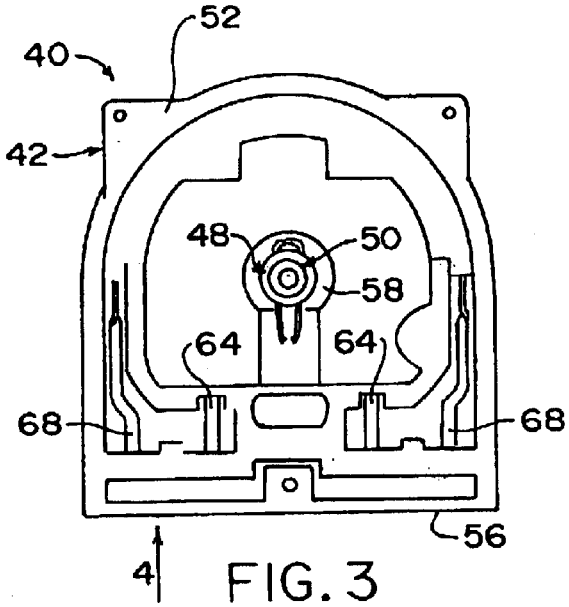
FIG. 3 is a diagrammatic rear view taken generally in the directing of arrow 3 in FIG. 2.
Figure 2:
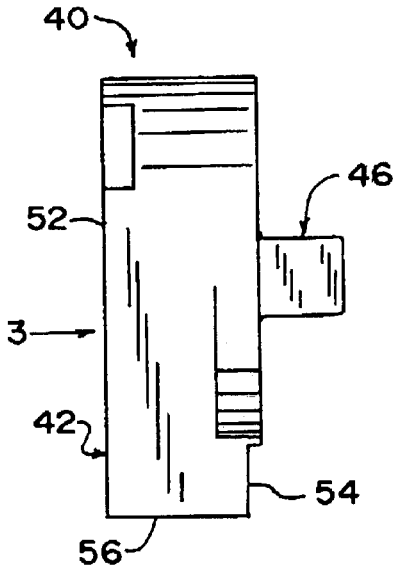
FIG. 2 is a diagrammatic side view taken generally in the directing of arrow 2 in FIG. 1.
Figure 1:
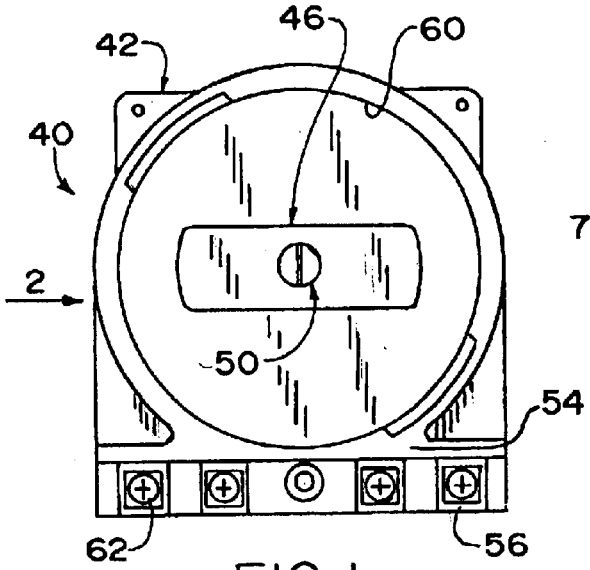
FIG. 1 is a diagrammatic front view of the present invention.
Figure 4:
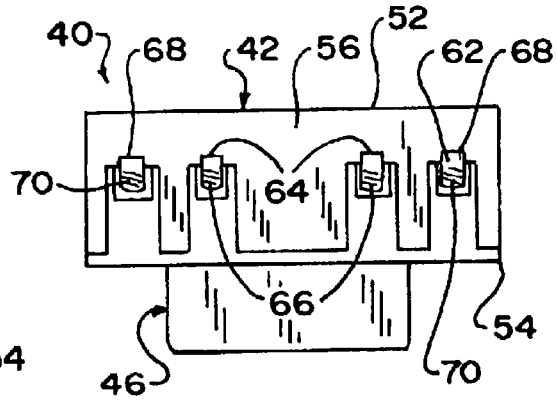
FIG. 4 is a diagrammatic bottom plan view taken generally in the direction of arrow 4 in FIG. 3.
Figure 5:
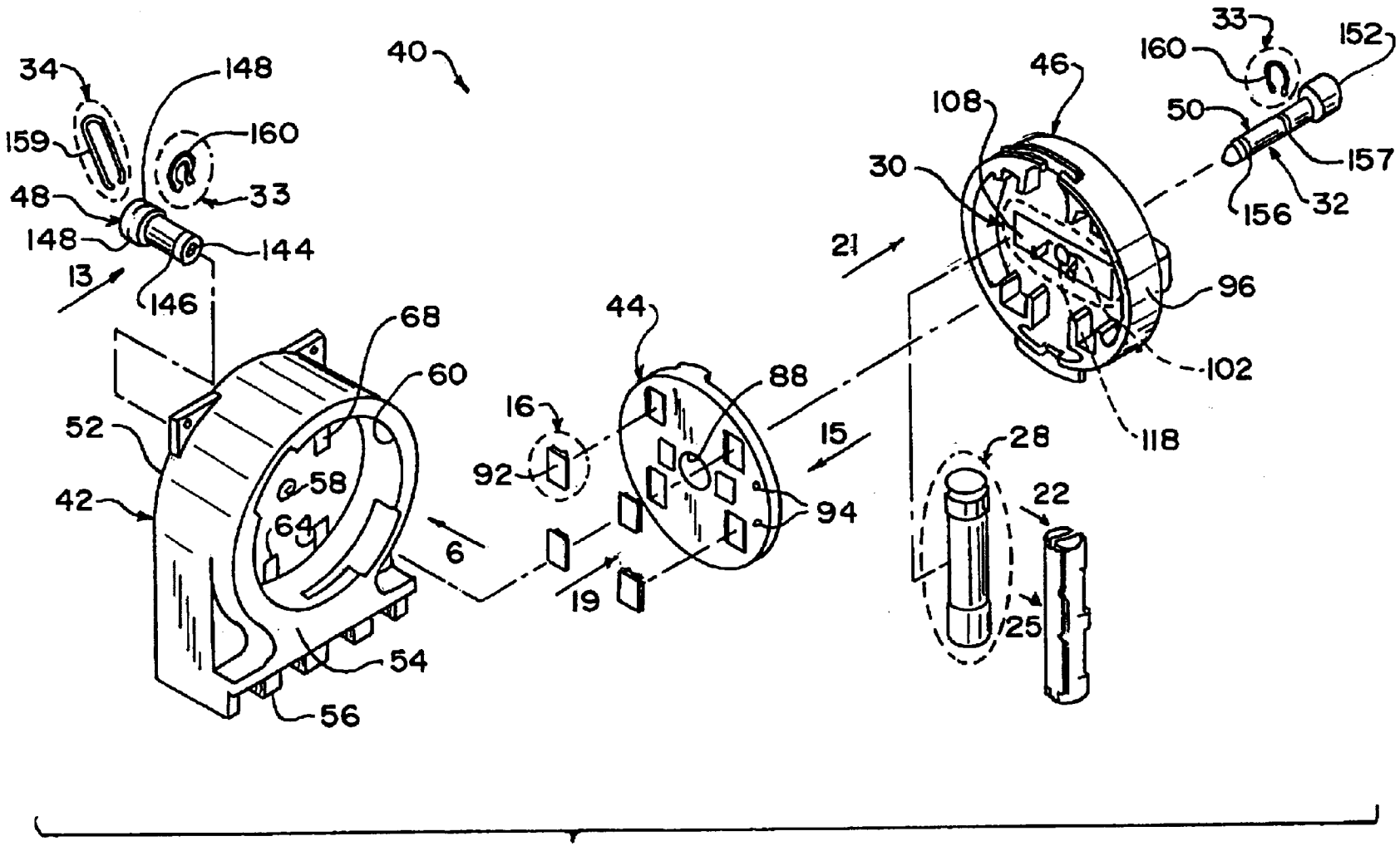
FIG. 5 is an exploded diagrammatic perspective view of the present invention shown in FIGS. 1–4.
Figures 21, 21A, 22, 23, 24, 25, 26, 27, 28, 29, 30, 31, 32:
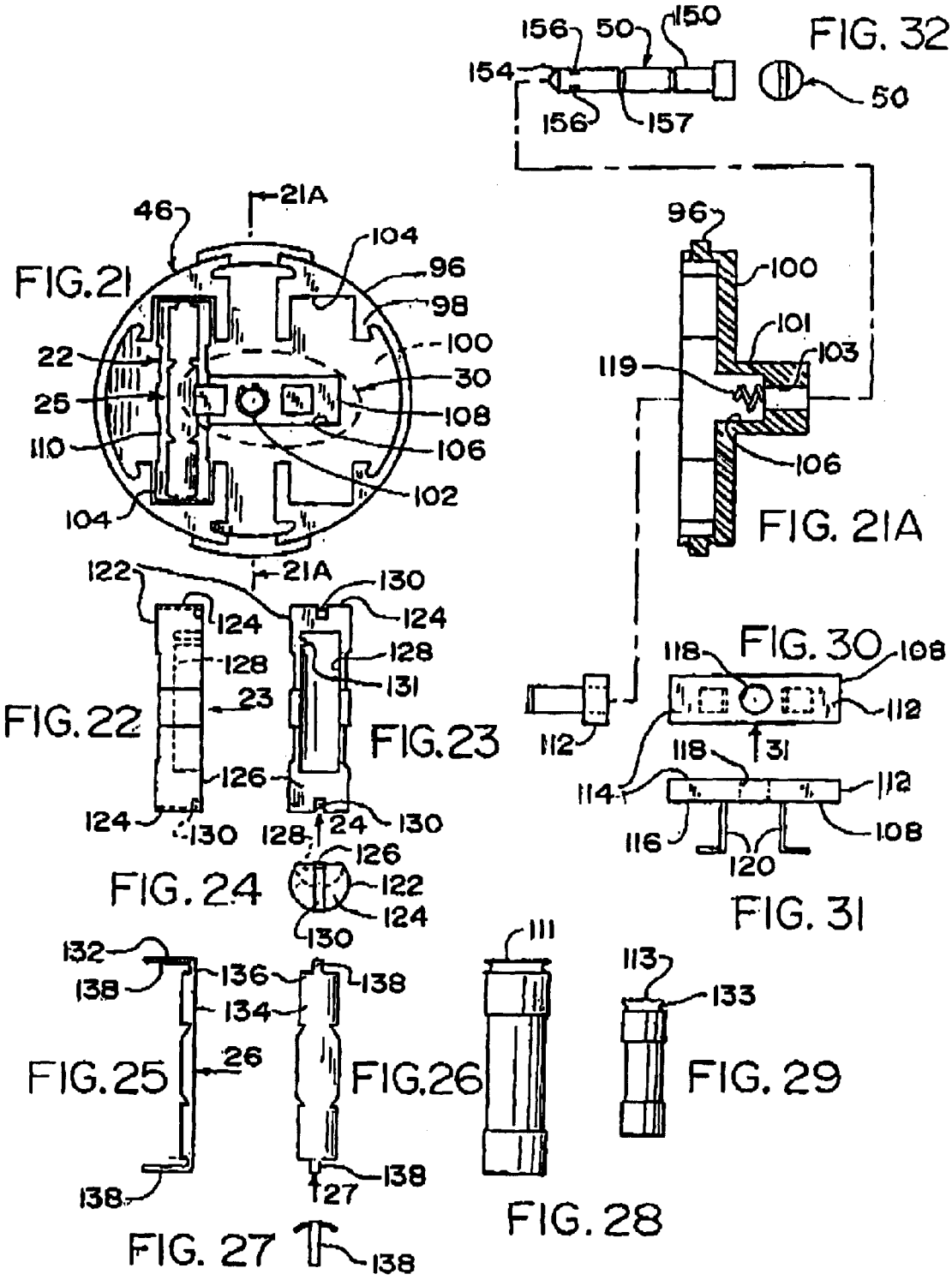
FIG. 21 is a diagrammatic rear view taken generally in the direction of arrow 21 in FIG. 5 of the handle assembly of the present invention.
FIG. 21A is a diagrammatic exploded cross sectional view taken along line 21A—21A in FIG. 21.
FIG.22 is an enlarged diagrammatic side view taken generally in the direction of arrow 22 in FIG. 21 and in FIG. 5 of the non-conductive portion of the fuse eliminator/adapter of the handle assembly of the present invention.
FIG. 23 is an enlarged diagrammatic top plan view taken generally in the direction of arrow 29 in FIG. 22.
FIG. 24 is a diagrammatic end view taken generally in the direction of arrow 24 in FIG. 23.
FIG. 25 is an enlarged diagrammatic side view taken generally in the direction of arrow 25 in FIG. 21 and in FIG. 5 of the conductive portion of the fuse eliminator/adapter of the handle assembly of the present invention.
FIG. 26 is an enlarged diagrammatic top plan view taken generally in the direction of arrow 26 in FIG. 25.
FIG. 27 is a diagrammatic end view taken generally in the direction of arrow 27 in FIG. 28.
FIG. 28 is a diagrammatic side view of the area generally enclosed by the dotted curve identified by arrow 28 in FIG.

5 of a large fuse for placement in the handle assembly without the need for the fuse eliminator/adapter of the handle assembly of the present invention;

FIG. 29 is a diagrammatic side view of a small fuse for placement in the handle assembly with the need for the fuse eliminator/adapter of the handle assembly of the invention;

FIG. 30 is a diagrammatic top plan view of the area generally enclosed by the dotted curve identified by arrow 30 in FIG. 21 and in FIG. 5 of the fuse retainer of the handle assembly of the present invention;

FIG. 31 is a diagrammatic side view taken generally in the direction of arrow 31 in FIG. 30;

FIG. 32 is an enlarged diagrammatic end view taken generally in the direction of arrow 32 in FIG. 21A of the pin of the present invention;

FIG. 33 is an diagrammatic top plan of the area generally enclosed by the dotted curve identified by arrow 33 in FIG. 5 of the horse shoe clip of the present invention; and FIG. 34 is a diagrammatic top plan view of the area generally enclosed by the dotted curve identified by arrow 34 in FIG. 5 of the hair pin clip of the present invention.

LIST OF REFERENCE NUMERALS UTILIZED IN THE DRAWING

40 rotary switch containing fuse capabilities of present invention
42 housing
44 electrical contact disc
46 handle assembly
48 pin-receiving bushing
50 pin
52 rear surface of housing 42
54 front surface of housing 42
56 bottom surface of housing 42
58 bushing-receiving through bore in housing 42
60 electrical contact disc/handle assembly-receiving blind bore in front surface 54 of housing 42
62 four wire-engaging electrical terminals of housing 42
64 pair of proximal electrical contacts of housing 42
66 inner pair of wire-engaging electrical terminals of four wire-engaging electrical terminals 62 of housing 42
68 pair of distal electrical contacts of housing 42
70 outer pair of wire-engaging electrical terminals of four wire-engaging electrical terminals 62 of housing 42
72 electrical contact disc-engaging detent pin assembly of housing 42
74 wire-receiving tube of each wire-engaging electrical terminal of four wire-engaging electrical terminals 62
76 wire-maintaining screw of each wire-engaging electrical terminal of four wire-engaging electrical terminals 62
78 detent assembly-receiving blind bore in electrical contact disc/handle assembly-receiving blind bore 60 in housing 42 of electrical contact disc-engaging detent pin assembly 72
80 pin-biasing coil spring of electrical contact disc-engaging detent pin assembly 72
82 detent pin of electrical contact disc-engaging detent pin assembly 72
84 handle assembly-facing front surface of electrical contact disc 44
86 housing-facing back surface of electrical contact disc 44
88 bushing-receiving through bore in electrical contact disc 44
90 two pair of contact-receiving through bores in electrical contact disc 44
92 four electrical contacts of electrical contact disc 44
94 pair of open/close detent-receiving blind bores in housing-facing back surface 86 of electrical contact disc 44
96 fuse-holding disc of handle assembly 46
100 ambient-facing front surface of fuse-holding disc 96 of handle assembly 46
101 turning handle of handle assembly 46
102 pin-receiving through bore in fuse-holding disc 96 of handle assembly 46
103 pin-receiving through bore in turning handle 101 of handle assembly 46
104 pair of fuse-receiving blind slots in electrical contact disc-facing back surface 98 of fuse-holding disc 96 of handle assembly 46
106 fuse retainer-receiving blind slot in electrical contact disc-facing back surface 98 of fuse-holding disc 96 of handle assembly 46
108 fuse retainer of handle assembly 46
110 fuse eliminator/adaptor of handle assembly 42
111 large fuse
112 base of fuse retainer 108 of handle assembly 46
113 small fuse
114 fuse holding disc-facing front surface of base 112 of fuse retainer 108 of handle assembly 46
116 electrical contact disc-facing rear surface of base 112 of fuse retainer 108 of handle assembly 46
118 pin-receiving through bore in base 112 of fuse retainer 108 of handle assembly 46
119 pair of fuse retainer-biasing coil springs of fuse retainer 108 of handle assembly 46
120 pair of fuse-engaging legs of fuse retainer 108 of handle assembly 46
122 non-conductive portion of fuse eliminator/adapter 110 of handle assembly 46
124 pair of end surfaces of non-conductive portion 122 of fuse eliminator/adapter 110 of handle assembly 46
126 electrical contact disc-facing surface of non-conductive portion 122 of fuse eliminator/adapter 110 of handle assembly 46
128 small fuse-receiving blind slot in non-conductive portion 122 of fuse eliminator/adapter 110 of handle assembly 46
130 pair of conductive portion-receiving blind slots in pair of end surfaces 124 of non-conductive portion 122 of fuse eliminator/adapter 110 of handle assembly 46, respectively.
131 small fuse groove-engaging pin of non-conductive portion 122 of fuse eliminator/adapter 110 of handle assembly 46
132 conductive jumper portion of fuse eliminator/adapter 110 of handle assembly 46
133 groove in small fuse 113
134 main portion of conductive jumper portion 132 of fuse eliminator/adapter 110 of handle assembly 46
136 pair of ends of main portion 134 of conductive jumper portion 132 of fuse eliminator/adapter 110 of handle assembly 46
138 pair of non-conductive portion-engaging legs of conductive jumper portion 132 of fuse eliminator/adapter 110 of handle assembly 46
140 ambient-facing rear end of pin-receiving bushing 48
142 handle assembly-facing front end of pin-receiving bushing 48
144 pin-receiving through bore in pin-receiving bushing 48
146 horse shoe clip-receiving blind slot in pin-receiving bushing 48
148 pair of hair pin clip-receiving through slots in pin-receiving bushing 48

150 shaft of pin 50
152 head of pin 50
154 free distal end of shaft 150 of pin 50
156 pair of hair pin clip-receiving blind slots in shaft 150 of pin 50
157 horse shoe clip-receiving blind slot in shaft 150 of pin 50
158 pin-turning blind slot in head 152 of pin 150
159 hair pin clip
160 horse shoe clip

DETAILED DESCRIPTION OF THE PREFERRED EMBODIMENT

Referring now to the figures, in which like numerals indicate like parts, and particularly to FIGS. 1–5, the rotary switch containing fuse capabilities of the present invention is shown generally at 40.

The rotary switch containing fuse capabilities 40 comprises a housing 42, an electrical contact disc 44, and a handle assembly 46. The electrical contact disc 44 is rotatively mounted in the housing 42. The handle assembly 46 is mounted to the electrical contact disc 44 and rotates therewith and is replaceably mounted in the housing 42 so as to allow the handle assembly 46 to be removed from the housing 42 and prevent inadvertent operation of the rotary switch containing fuse capabilities. 40.

The rotary switch containing fuse capabilities 40 further comprises a pin-receiving bushing 48. The pin-receiving bushing 48 extends fixedly into the housing 42.

The rotary switch containing fuse capabilities 40 further comprises a pin 50. The pin 50 extends rotatively through the handle assembly 46 and the electrical contact disc 44 and rotatively into the pin-receiving bushing.

The specific configuration of the housing 42 can best be seen in FIGS. 1–6, and as such, will be discussed with reference thereto.

The housing 42 has a rear surface 52, a front surface 54, a bottom surface 56, and a bushing-receiving through bore 58. The bushing-receiving through bore 58 extends axially through the housing 42, from the rear surface 52 thereof to the front surface 54 thereof.

The front surface 54 of the housing 42 has an electrical contact disc/handle assembly-receiving blind bore 60. The electrical contact disc/handle assembly-receiving blind bore 60 in the housing 42 is concentric with, but substantially larger than, the bushing-receiving through bore 58 in the housing 42.

The housing 42 further has four wire-engaging electrical terminals 62. The four wire-engaging electrical terminals 62 are recessed in the front surface 54 of the housing 42, directly above the bottom surface 58 of the housing 42.

The housing 42 further has a pair of proximal electrical contacts 64. The pair of proximal electrical contacts 64 are parallel to each other, sit in the electrical contact disc/handle assembly-receiving blind bore 60 in the housing 42, and electrically communicate with an inner pair 66 of the four wire-engaging electrical terminals 62.

The housing 42 further has a pair of distal electrical contacts 68. The pair of distal electrical contacts 68 are parallel to each other, sit in the electrical contact disc/handle assembly-receiving blind bore 60 in the housing 42, and electrically communicate with an outer pair 70 of the four wire-engaging electrical terminals 62.

The housing 42 further has an electrical contact disc-engaging detent pin assembly 72. The electrical contact disc-engaging detent pin assembly 72 sits in the electrical contact disc/handle assembly-receiving blind bore 60 in the housing 42.

The specific configuration of a typical one of the four wire-engaging electrical terminals 62 can best be seen in FIG. 7, and as such, will be discussed with reference thereto.

The typical one of the four wire-engaging electrical terminals 62 comprises a wire-receiving tube 74. The wire-receiving tube 74 is recessed in the front surface 54 of the housing 42.

The typical one of the four wire-engaging electrical terminals 62 further comprises a wire-maintaining screw 76. The wire-maintaining screw 76 extends threadably into the wire-receiving tube 74.

The specific configuration of a typical one of the pair of proximal electrical contacts 64 can best be seen in FIG. 8, and as such, will be discussed with reference thereto.

The typical one of the pair of proximal electrical contacts 64 is slender, elongated, flat, and extends from an associated one of the four wire-engaging electrical terminals 62, into the electrical contact disc/handle assembly-receiving blind bore 60, to before the bushing-receiving through bore 58.

The specific configuration of a typical one of the pair of distal electrical contacts 68 can best be seen in FIGS. 9 and 10, and as such, will be discussed with reference thereto.

The typical one of the pair of distal electrical contacts 68 is slender, elongated, arcuate-shaped, and extends from an associated one of the four wire-engaging electrical terminals 62, into, and conforms to, the electrical contact disc/handle assembly-receiving blind bore, to after the bushing-receiving through bore 58.

The specific configuration of the electrical contact disc-engaging detent pin assembly 72 can best be seen in FIGS. 11 and 12, and as such, will be discussed with reference thereto.

The electrical contact disc-engaging detent pin assembly 72 comprises the electrical contact disc/handle assembly-receiving blind bore 60 having a detent assembly-receiving blind bore 78. The detent assembly-receiving blind bore 78 is disposed between one of the pair of proximal electrical contacts 84 and an adjacent one of the pair of distal electrical contacts 68.

The electrical contact disc-engaging detent pin assembly 72 further comprises a pin-biasing coil spring 80. The pin-biasing coil spring 80 sits in the detent assembly-receiving blind bore 78.

The electrical contact disc-engaging detent pin assembly 72 further comprises a detent pin 82. The detent pin 82 sits in the detent assembly-receiving blind bore 78, against, and is biased outwardly by, the pin-biasing coil spring 80.

The specific configuration of the electrical contact disc 44 can best be seen in FIGS. 15–20, and as such, will be discussed with reference thereto.

The electrical contact disc 44 has a handle assembly-facing front surface 84, a housing-facing back surface 86, and a bushing-receiving through bore 88. The bushing-receiving through bore 88 in the electrical contact disc 44 extends centrally therethrough, from the handle assembly-facing front surface 84 thereof to the housing-facing back surface 86 thereof, and is aligned with the bushing-receiving through bore 58 in the housing 42.

The electrical contact disc 44 further has two pair of contact-receiving through bores 90. The two pair of contact-receiving through bores 90 in the electrical contact disc 44 extend from the handle assembly-facing front surface 84 thereof to the housing-facing back surface 86 thereof, and straddle the bushing-receiving through bore 88. A contact-receiving through bore of each pair of the two pair of contact-receiving through bores 90 are aligned with each other.

The electrical contact disc 44 further has four electrical contacts 92. The four electrical contacts 92 rest in the two pair of contact-receiving through bores 90, respectively, and are electrically conductive from both the handle assembly-facing front surface 84 of the electrical contact disc 44 and the housing-facing back surface 86 of the electrical contact disc 44.

The housing-facing back surface 86 of the electrical contact disc 44 has a pair of open/close detent-receiving blind bores 94. The pair of open/close detent-receiving blind bores 94 are disposed outboard of one pair of the two pair of contact-receiving through bores 90, and are positioned to receive the detent pin 82. One open/close detent-receiving blind bore 94 receives the detent pin 82 when the handle assembly 46 is rotated to close the switch 40 and the other open/close detent-receiving blind bore 94 receives the detent pin 82 when the handle assembly 46 is rotated to open the switch 40.

The configuration of the handle assembly 46 can best be seen in FIG. 21, and as such, will be discussed with reference thereto.

The handle assembly 46 comprises a fuse-holding disc 96. The fuse holding disc 96 has an electrical contact disc-facing back surface 98, an ambient-facing front surface 100, and a pin-receiving through bore 102. The pin-receiving through bore 102 in the fuse-holding disc 96 extends centrally therethrough, from the electrical contact disc-facing surface 98 thereof to the ambient-facing front surface 100 thereof, and 18 aligned with the bushing-receiving through bore 88 in the electrical contact disc 44.

The handle assembly 46 has a turning handle 101 (see FIG. 21A). The turning handle 101 extends diametrically across the ambient-facing front surface 100 of the fuse-holding disc 96, and has a pin-receiving through bore 103. The pin-receiving through bore 103 in the turning handle 101 extends centrally therethrough and is aligned with the pin-receiving through bore 102 in the fuse-holding disc 96.

The electrical contact disc-facing back surface 98 of the fuse-holding disc 96 has a pair of fuse-receiving blind slots 104. The pair of fuse-receiving blind slots 104 are parallel to each other and straddle the pin-receiving through bore 102 in the fuse-holding disc 96.

The electrical contact disc-facing back surface 98 of the fuse-holding disc 96 further has a fuse retainer-receiving blind slot 106. The fuse retainer-receiving blind slot 106 in the fuse-holding disc 96 extends diametrically thereacross, and communicates perpendicularly with, but is deeper than, the pair of fuse-receiving blind slots 104.

The fuse-holding disc 96 further has a fuse retainer 108. The fuse retainer 108 sits axially movable in the fuse retainer-receiving blind slot 106 in the fuse-holding disc 96.

The fuse-holding disc 96 further has a fuse eliminator/adaptor 110. The fuse eliminator/adapter 110 sits in the fuse retainer 108 in place of a large fuse 111 (see FIG. 28) when no large fuse 111 is used or when a small fuse 113 (see FIG. 29) is used.

The specific configuration of the fuse retainer 108 can best be seen in FIGS. 30 and 31, and as such, will be discussed with reference thereto.

The fuse retainer 108 has a base 112. The base 112 of the fuse retainer 108 conforms to, and sits axially movable in, the fuse retainer-receiving blind slot 106 in the fuse-holding disc 96.

The base 112 of the fuse retainer 108 has a fuse holding disc-facing front surface 114, an electrical contact disc-facing rear surface 116, and a pin-receiving through bore 118. The pin receiving through bore 118 in the base 112 extends centrally therethrough, from the fuse holding disc-facing front surface 114 thereof to the electrical contact disc-facing rear surface 116 thereof, and is aligned with the pin-receiving throughbore 102 in the fuse-holding disc 96.

The fuse retainer 108 further has a pair of fuse retainer-biasing coil springs 119 (see FIG. 21A). The pair of fuse retainer-biasing coil springs 119 sit axially in the fuse retainer-receiving blind slot 106 in the fuse-holding disc 96, straddle the pin-receiving through bore 102 in the fuse-holding disc 96, and bias against the fuse holding disc-facing front surface 114 of, and urge outwardly, the base 112 of the fuse retainer 108 so as to allow the fuse 111 and/or the fuse eliminator/adapter 110 to be pressed into electrical communication with the four electrical contacts 92 of the electrical contact disc 44, respectively, which then press against the pair of proximal electrical contacts 64 and the pair of distal electrical contacts 68 of the housing 42, respectively.

The fuse retainer 108 further has a pair of fuse-engaging legs 120. The pair of fuse-engaging legs 120 are L-shaped, extend from the electrical contact disc-facing rear surface 116 of the base 112, and straddle the pin-receiving through bore 118 in the base 112. The pair of fuse-engaging legs 120 hold the large fuse 111 (see FIG. 28) and/or the fuse eliminator/adapter 110, depending upon whether the large fuse 111 (see FIG. 28) is used and/or if at least one of the fuses used is the small fuse 113 (see FIG. 29).

The specific configuration of the fuse eliminator/adapter 110 can best be seen in FIGS. 22–27, and as such, will be discussed with reference thereto.

As shown in FIGS. 22–24, the fuse eliminator/adapter 110 comprises a non-conductive portion 122. The non-conductive portion 122 of the fuse eliminator/adapter 110 is substantially cylindrically-shaped, sits in an associated one of the pair of fuse-receiving blind slots 104 in the fuses holding disc 96, and is used to hold the small fuse 113 (see FIG. 29) when the small fuse 113 is used.

The non-conductive portion 122 of the fuse eliminator/adapter 110 has a pair of end surfaces 124, an electrical contact disc-facing surface 126, and a small fuse-receiving blind slot 128. The small fuse-receiving blind slot 128 extends in the electrical contact disc-facing surface 126 of the non-conductive portion, from short of one end surface 124 of the non-conductive portion 122 to short of the other end surface 124 of the non-conductive portion 122, and holds the small fuse 113 (see FIG. 29) when the small fuse 113 is used.

The pair of end surfaces 124 of the non-conductive portion 122 of the fuse eliminator/adapter 110 have a pair of conductive portion-receiving blind slots 130, respectively. The pair of conductive portion-receiving blind slots 130 extend diametrically across the pair of end surfaces 124, respectively.

The non-conductive portion 122 of the fuse eliminator/adapter 110 further has small fuse groove-engaging pin 131. The small fuse groove-engaging pin 131 extends laterally movable through the non-conductive portion 122 and into the small fuse-receiving blind slot 128 therein and engages in a groove 133 in the small fuse 113 (see FIG. 29) when a grooved small fuse is required or else if a non-grooved small fuse is used and a grooved small fuse is required, the small fuse groove-engaging pin 131 would be urged outwardly by the non-grooved small fuse preventing insertion of the fuse eliminator/adapter 110 into an associated one of the pair of fuse-receiving blind slots 104 in the fuse-holding disc 96 and thereby guard against use of an improper fuse.

As shown in FIGS. 25–27, the fuse eliminator/adapter 110 further comprises a conductive jumper portion 132. The conductive jumper portion 132 of the fuse eliminator/adapter 110 is replaceably attached to the non-conductive portion 122 of the fuse eliminator/adapter 110, and is used when no fuse is used.

The conductive jumper portion 132 has a main portion 134. The main portion 134 of the conductive jumper portion 132 is thin, extends across the electrical contact disc-facing surface 126 of the non-conductive portion 122, closes the small fuse-receiving blind slot 128 therein, and has a pair of ends 136.

The conductive portion 122 of the fuse eliminator/adapter 110 further has a pair of non-conductive portion-engaging legs 135. The pair of non-conductive portion-engaging legs 138 depend from the pair of ends 136 of the main portion 134, respectively, and replaceably engage in the pair of conductive portion-receiving blind slots 130 in the non-conductive portion 122, respectively.

The specific configuration of the pin-receiving bushing 48 can best be seen in FIGS. 13 and 14, and as such, will be discussed with reference thereto.

The pin-receiving bushing 48 is cylindrically-shaped and has an ambient-facing rear end 140, a handle assembly-facing front end 142, and a pin-receiving through bore 144. The ambient-facing rear end 140 is diametrically wider than, and coaxial with, the handle assembly-facing front end 142. The pin-receiving through bore 144 extends coaxially in the pin-receiving bushing 48, from the ambient-facing rear end 140 thereof to the handle assembly-facing front end 142 thereof.

The pin-receiving bushing 48 further has a horse shoe clip-receiving blind slot 146. The horse shoe clip-receiving blind slot 146 extends circumferentially around the pin-receiving bushing 48, just inward of the handle assembly-facing front end 142 thereof.

The pin-receiving bushing 48 further has a pair of hair pin clip-receiving through slots 148. The pair of hair pin clip-receiving through slots 148 are parallel to each other, extend along chords of the ambient-facing rear end 140, and straddle the pin-receiving through bore 144.

The specific configuration of the pin 50 can best be seen in FIG. 32, and as such, will be discussed with reference thereto.

The pin 50 is slender, elongated, and has a shaft 150 and a head 152.

The shaft 150 of the pin 50 has a free distal end 154, a pair of hair pin clip-receiving blind slots 156, and a horse shoe clip-receiving blind slot 157. The pair of hair pin clip-receiving blind slots 156 are parallel to each other and extend along chords of the shaft 150, just inward of the free distal end 154 of the shaft 150, and are alignable with the pair of hair pin clip-receiving through slots 148 in the pin-receiving bushing 4. The horse shoe clip-receiving blind slot 157 extends circumferentially around, and midway along, the shaft 150.

The head 152 of the pin 150 has a pin-turning blind slot 158. The pin-turning blind slot 158 extends diametrically across the head 152 of the pin, and is oriented 90 degrees relative to the pair of hair pin clip-receiving blind slots 156 in the shaft 150.

The overall assemblage of the rotary switch containing fuse capabilities 10 can best be seen in FIG. 5, and as such, will be discussed with reference thereto.

A hair pin clip 159 (see FIG. 34) engages the pair of hair pin clip-receiving through slots 148 in the pin-receiving bushing 48.

The pin-receiving bushing 48 extends in the bushing-receiving through bore 58 in the housing 42 and the bushing-receiving through bore 88 in the electrical contact disc 44 and engages a horse shoe clip 160 (see FIG. 33) that engages in the horse shoe clip-receiving blind slot 146 in the pin-receiving bushing 48, and in doing so, rotatively attaches the electrical contact disc 44 in the housing 42.

The pin 50 extends in the pin-receiving through bore 102 in the handle assembly 46, the pin-receiving through bore 118 in the fuse retainer 108, and engages another horse shoe clip 160 (see FIG. 33) that engages in the horse shoe clip-receiving blind slot 157 in the pin 50, and in doing so, axially movably attaches the fuse retainer 108 to the fuse-holding disc 96 of the handle assembly 46.

The pin 50 then extends in the pin-receiving through bore 144 in the pin-receiving bushing 48 and the pair of hair pin clip-receiving blind slots 156 in the pin 50 engage the hair pin clip 159, and in so doing, the handle assembly 46 can rotate relative to, but cannot be removed from, the housing 42, unless the pin 50 is rotated 90 degrees, via the pin-turning slot 152 therein, which would orientate the pair of hair pin-receiving through slots 148 out of engagement with the hair pin clip 159.

It will be understood that each of the elements described above, or two or more together, may also find a useful application in other types of constructions differing from the types described above.

While the invention has been illustrated and described as embodied in a rotary switch containing fuse capabilities, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A rotary switch containing fuse capabilities, comprising:

a) a housing;

b) an electrical contact disc; and c) a handle assembly;

wherein said electrical contact disc it rotatively mounted in said housing;

wherein said handle assembly is mounted to said electrical contact disc;

wherein said handle assembly rotates with said electrical contact disc; and wherein said handle assembly is replaceably mounted in said housing so as to allow said handle assembly to be removed from said housing and prevent inadvertent operation of said rotary switch further comprising a pin-receiving bushing; and wherein said pin receiving bushing extends fixedly into said housing.

2. The switch as defined in claim 1, further comprising a pin; and wherein said pin extends rotatively through said handle assembly and said electrical contact disc and rotatively into said pin-receiving bushing.

3. The switch as defined in claim 2, wherein said housing has a rear surface;

wherein said housing has a front surface;

wherein said housing has a bottom surface;

wherein said housing has a bushing-receiving through bore;

wherein said bushing-receiving through bore extends axially through said housing; and wherein said bushing-receiving through bore extends from said rear surface of said housing to said front surface of said housing.

4. The switch as defined in claim 3, wherein said front surface of said housing has an electrical contact disc/handle assembly-receiving blind bore;

wherein said electrical contact disc/handle assembly-receiving blind bore in said housing is concentric with said bushing-receiving through bore in said housing; and wherein said electrical contact disc/handle assembly-receiving blind bore in said housing is substantially larger than said bushing-receiving through bore in said housing.

5. The switch as defined in claim 4, wherein said housing has an electrical contact disc-engaging detent pin assembly; and wherein said electrical contact disc-engaging detent pin assembly sits in said electrical contact disc/handle assembly-receiving blind bore in said housing.

6. The switch as defined in claim 4, wherein said housing has four wire-engaging electrical terminals;

wherein said four wire-engaging electrical terminals are recessed in said front surface of said housing; and wherein said four wire-engaging electrical terminals are directly above said bottom surface of said housing.

7. The switch as defined in claim 6, wherein said housing has a pair of proximal electrical contacts;

wherein said pair of proximal electrical contacts are parallel to each other;

wherein said pair of proximal electrical contacts sit in said electrical contact disc/handle assembly-receiving blind bore in said housing; and wherein said pair of proximal electrical contacts electrically communicate with an inner pair of said four wire-engaging electrical terminals.

8. The switch as defined in claim 7, wherein each one of said pair of proximal electrical contacts is slender;

wherein each one of said pair of proximal electrical contacts is elongated;

wherein each one of said pair of proximal electrical contacts is flat; and wherein each one of said pair of proximal electrical contacts extends from an associated one of said four wire-engaging electrical terminals, into said electrical contact disc/handle assembly-receiving blind bore, to before said bushing-receiving through bore in said housing.

9. The switch as defined in claim 7, wherein each one of said pair of distal electrical contacts is slender;

wherein each one of said pair of distal electrical contacts is elongated;

wherein each one of said pair of distal electrical contacts is arcuate-shaped;

wherein each one of said pair of distal electrical contacts extends from an associated one of said four wire-engaging electrical terminals, into said electrical contact disc/handle assembly-receiving blind bore, to after said bushing-receiving through bore in said housing; and wherein each one of said pair of distal electrical contacts conforms to said electrical contact disc/handle assembly-receiving blind bore.

10. The switch as defined in claim 6, wherein each one of said four wire-engaging electrical terminals comprises a wire-receiving tube; and wherein said wire-receiving tube is recessed in said front surface of said housing.

11. The switch as defined in claim 10, wherein each one of said four wire-engaging electrical terminals comprises a wire-maintaining screw; and wherein said wire-maintaining screw extends threadably into said wire-receiving tube.

12. The switch as defined in claim 7, wherein said housing has a pair of distal electrical contacts;

wherein said pair of distal electrical contacts are parallel to each other;

wherein said pair of distal electrical contacts sit in said electrical contact disc/handle assembly-receiving blind bore in said housing; and wherein said pair of distal electrical contacts electrically communicate with an outer pair of said four wire-engaging electrical terminals.

13. The switch as defined in claim 12, wherein said electrical contact disc-engaging detent pin assembly comprises said electrical contact disc/handle assembly-receiving blind bore having a detent assembly-receiving blind bore; and wherein said detent assembly-receiving blind bore is disposed between one of said pair of proximal electrical contacts and an adjacent one of said pair of distal electrical contacts.

14. The switch as defined in claim 13, wherein said electrical contact disc-engaging detent pin assembly comprises a pin-biasing coil spring; and wherein said pin-biasing coil spring sits in said detent assembly-receiving blind bore.

15. The switch as defined in claim 13, wherein said electrical contact disc-engaging detent pin assembly comprises a detent pin;

wherein said detent pin sits in said detent assembly-receiving blind bore;

wherein said detent pin sits against said pin-biasing coil spring; and wherein said detent pin is biased outwardly by said pin-biasing coil spring.

16. The switch as defined in claim 15, wherein said electrical contact disc has a handle assembly-facing front surface;

wherein said electrical contact disc has a housing-facing back surface;

wherein said electrical contact disc has a bushing-receiving through bore;

wherein said bushing-receiving through bore in said electrical contact disc extends centrally therethrough;

wherein said bushing-receiving through bore in said electrical contact disc extends from said handle assembly-facing front surface thereof to said housing-facing back surface thereof; and wherein said bushing-receiving through bore in said electrical contact disc is aligned with said bushing-receiving through bore in said housing.

17. The switch as defined in claim 16, wherein said pin-receiving bushing extends in said bushing-receiving through bore in said housing and said bushing-receiving through bore in said electrical contact disc and engages a horse shoe clip that engages in said horse shoe clip-receiving blind slot in said pin-receiving bushing, and in doing so, rotatively attaches said electrical contact disc in said housing.

18. The switch as defined in claim 16, wherein said electrical contact disc has two pair of contact-receiving through bores;

wherein said two pair of contact-receiving through bores in said electrical contact disc extend from said handle assembly-facing front surface thereof to said housing-facing back surface thereof;

wherein said two pair of contact-receiving through bores in said electrical contact disc straddle said bushing-receiving through bore therein; and wherein a contact-receiving through bore of each pair of said two pair of contact-receiving through bores are aligned with each other.

19. The switch as defined in claim 18, wherein said electrical contact disc has four electrical contacts;

wherein said four electrical contacts rest in said two pair of contact-receiving through bores, respectively; and wherein said four electrical contacts of said electrical contact disc are electrically conductive from both said handle assembly-facing front surface and said housing-facing back surface.

20. The switch as defined in claim 18, wherein said housing-facing back surface of said electrical contact disc has a pair of open/close detent-receiving blind bores;

wherein said pair of open/close detent-receiving blind bores in said electrical contact disc are disposed outboard of one pair of said two pair of contact-receiving through bores therein;

wherein said pair of open/close detent-receiving blind bores in said electrical contact disc are positioned to receive said detent pin;

wherein one open/close detent-receiving blind bore receives said detent pin when said handle assembly is rotated to close said rotary switch; and wherein the other open/close datent-receiving blind bore receives said detent pin when said handle assembly is rotated to open said switch.

21. The switch as defined in claim 16, wherein said handle assembly comprises a fuse-holding disc;

wherein said fuse holding disc has an electrical contact disc-facing back surface;

wherein said fuse holding disc has an ambient-facing front surface;

wherein said fuse holding disc has a pin-receiving through bore;

wherein said pin-receiving through bore in said fuse-holding disc extends centrally therethrough;

wherein said pin-receiving through bore in said fuse-holding disc extends from said electrical contact disc-facing surface thereof to said ambient-facing front surface thereof; and wherein said pin-receiving through bore in said fuse-holding disc is aligned with said bushing-receiving through bore in said electrical contact disc.

22. The switch as defined in claim 21, wherein said handle assembly has a turning handle;

wherein said turning handle extends diametrically across said ambient-facing front surface of said fuse-holding disc;

wherein said turning handle has a pin-receiving through bore;

wherein said pin-receiving through bore in said turning handle extends centrally therethrough; and wherein said pin-receiving through bore in said turning handle is aligned with said pin-receiving through bore in said fuse-holding disc.

23. The switch as defined in claim 21, wherein said electrical contact disc-facing back surface of said fuse-holding disc has a pair of fuse-receiving blind slots;

wherein said pair of fuse-receiving blind slots are parallel to each other; and wherein said pair of fuse-receiving blind slots straddle said pin-receiving through bore in said fuse-holding disc.

24. The switch as defined in claim 23, wherein said electrical contact disc-facing back surface of said fuse-holding disc has a fuse retainer-receiving blind slot;

wherein said fuse retainer-receiving blind slot in said fuse-holding disc extends diametrically thereacross;

wherein said fuse retainer-receiving blind slot in said fuse-holding disc communicates perpendicularly with said pair of fuse-receiving blind slots therein; and wherein said fuse retainer-receiving blind slot in said fuse-holding disc is deeper than said pair of fuse-receiving blind slots therein.

25. The switch as defined in claim 24, wherein said fuse-holding disc has a fuse retainer; and wherein said fuse retainer sits axially movable in said fuse retainer-receiving blind slot in said fuse-holding disc.

26. The switch as defined in claim 25, wherein said pin-receiving bushing is cylindrically-shaped;

wherein said pin-receiving bushing has an ambient-facing rear end;

wherein said pin-receiving bushing has a handle assembly-facing front end;

wherein said pin-receiving bushing has a pin-receiving a through bore;

wherein said ambient-facing rear end is diametrically wider than said handle assembly-facing front end;

wherein said ambient-facing rear end is coaxial with said handle assembly-facing front end;

wherein said pin-receiving through bore extends coaxially in said pin-receiving bushing; and wherein said pin-receiving through bore in said pin-receiving bushing extends from said ambient-facing rear end thereof to said handle assembly-facing front end thereof.

27. The switch as defined in claim 26, wherein said pin-receiving bushing has a horse shoe clip-receiving blind slot;

wherein said horse shoe clip-receiving blind slot extends circumferentially around said pin-receiving bushing; and wherein said horse shoe clip-receiving blind slot in said pin-receiving bushing is just inward of said handle assembly-facing front end.

28. The switch as defined in claim 26, wherein said pin-receiving bushing has a pair of hair pin clip-receiving through slots;

wherein said pair of hair pin clip-receiving through slots are parallel to each other;

wherein said pair of hair pin clip-receiving through slots in said pin-receiving bushing extend along chords of said ambient-facing rear end thereof; and wherein said pair of hair pin clip-receiving through slots straddle said pin-receiving through bore in said pin-receiving bushing.

29. The switch as defined in claim 26, wherein said pin is slender;

wherein said pin is elongated;

wherein said pin has a shaft; and wherein said pin has a head.

30. The switch as defined in claim 29, wherein said shaft of said pin has a free distal end;

wherein said shaft of said pin has a pair of hair pin clip-receiving blind slots;

wherein said shaft of said pin has a horse shoe clip-receiving blind slot;

wherein said pair of hair pin clip-receiving blind slots are parallel to each other;

wherein said pair of hair pin clip-receiving blind slots extend along chords of said shaft;

wherein said pair of hair pin clip-receiving blind slots are just inward of said free distal end of said shaft;

wherein said pair of hair pin clip-receiving blind slots are alignable with said hair pin clip-receiving through slots in said pin-receiving bushing;

wherein said horse shoe clip-receiving blind slot extends circumferentially around said shaft; and wherein said horse shoe clip-receiving blind slot extends midway along said shaft.

31. The switch as defined in claim 30, wherein a hair pin clip engages said pair of hair pin clip-receiving through slots in said pin-receiving bushing.

32. The switch as defined in claim 30, wherein said head of said pin has a pin-turning blind slot;

wherein said pin-turning blind slot extends diametrically across said head of said pin; and wherein said pin-turning blind slot is oriented 90 degrees relative to said pair of hair pin clip-receiving blind slots in said shaft.

33. The switch as defined in claim 32, wherein said pin extends in said pin-receiving through bore in said handle assembly, said pin-receiving through bore in said fuse retainer and engages a horse shoe clip that engages in said horse shoe clip-receiving blind slot in said pin, and in doing so, axially movably attaches said fuse retainer to said fuse-holding disc of said handle assembly, said pin then extends in said pin-receiving through bore in said pin-receiving bushing and said pair of hair pin clip-receiving blind slots in said pin are engaged by said hair pin clip, and in so doing, said handle assembly can rotate relative to, but cannot be removed from, said housing assembly, unless said pin is rotated 90 degrees, via said pin-turning slot therein, which would orientate said pair of hair pin-receiving through slots out of engagement with said hair pin clip.

34. The switch as defined in claim 25, wherein said fuse-holding disc has a fuse eliminator/adaptor; and wherein said fuse eliminator/adapter sits in said fuse retainer in place of a large fuse when no large fuse is used or when a small fuse is used.

35. The switch as defined in claim 34, wherein said fuse eliminator/adapter comprises a non-conductive portion;

wherein said non-conductive portion of said fuse eliminator/adapter is substantially cylindrically-shaped;

wherein said non-conductive portion of said fuse eliminator/adapter sits in an associated one of said pair of fuse-receiving blind slots in said fuse-holding disc; and wherein said non-conductive portion of said fuse eliminator/adapter is used to hold a small fuse when a small fuse is used.

36. The switch as defined in claim 35, wherein said non-conductive portion of said fuse eliminator/adapter has a pair of end surfaces;

wherein said non-conductive portion of said fuse eliminator/adapter has an electrical contact disc-facing surface;

wherein said non-conductive portion of said fuse eliminator/adapter has a small fuse-receiving blind slot;

wherein said small fuse-receiving blind slot extends in said electrical contact disc-facing surface thereof; and wherein said small fuse-receiving blind slot extends from short of one end surface of said non-conductive portion to short of the other end surface of said non-conductive portion.

37. The switch as defined in claim 36, wherein said pair of end surfaces of said non-conductive portion of said fuse eliminator/adapter have a pair of conductive portion-receiving blind slots, respectively; and wherein said pair of conductive portion-receiving blind slots extend diametrically across said pair of end surfaces, respectively.

38. The switch as defined in claim 37, wherein said fuse eliminator/adapter comprises a conductive jumper portion;

wherein said conductive jumper portion of said fuse eliminator/adapter is replaceably attached to said non-conductive portion of said fuse eliminator/adapter; and wherein said conductive jumper portion of said fuse eliminator/adapter is used when no fuse is used.

39. The switch as defined in claim 38, wherein said conductive jumper portion has a main portion;

wherein said main portion of said conductive jumper portion is thin;

wherein said main portion of said conductive jumper portion extends across said electrical contact disc-facing surface of said non-conductive portion;

wherein said main portion of said conductive jumper portion closes said small fuse-receiving blind slot in said non-conductive portion; and wherein said main portion of said conductive jumper portion has a pair of ends.

40. The switch as defined in claim 39, wherein said conductive jumper portion of said fuse eliminator/adapter has a pair of non-conductive portion-engaging legs;

wherein said pair of non-conductive portion-engaging legs depend from said pair of ends of said main portion, respectively;

wherein said pair of non-conductive portion-engaging legs replaceably engage in said pair of conductive portion-receiving blind slots in said non-conductive portion, respectively.

41. The switch as defined in claim 36, wherein said non-conductive portion of said fuse eliminator/adapter has a small fuse groove-engaging pin; and wherein said small fuse groove-engaging pin extends laterally movable through said non-conductive portion and into said small fuse-receiving blind slot and engages in a groove in a small fuse when a grooved small fuse is required or else if a non-grooved small fuse is used and a grooved small fuse is required, said small fuse groove-engaging pin would be urged outwardly by the non-grooved small fuse preventing insertion of said fuse eliminator/adapter into an associated one of said pair of fuse-receiving blind slots in fuse-holding disc and thereby guard against use of an improper fuse.

42. The switch as defined in claim 25, wherein said fuse retainer has a base;

wherein said base of said fuse retainer conforms to said fuse retainer-receiving blind slot in said fuse-holding disc; and wherein said base of said fuse retainer sits axially movable in said fuse retainer-receiving blind slot in said fuse-holding disc.

43. The switch as defined in claim 42, wherein said base of said fuse retainer has a fuse holding disc-facing front surface;

wherein said base of said fuse retainer has an electrical contact disc-facing rear surface;

wherein said base of said fuse retainer has a pin-receiving through bore;

wherein said pin receiving through bore in said base extends centrally therethrough;

wherein said pin receiving through bore in said base extends from said fuse holding disc-facing front surface thereof to said electrical contact disc-facing rear surface thereof; and wherein said pin receiving through bore in said base is aligned with said pin-receiving throughbore in said fuse-holding disc.

44. The switch as defined in claim 43, wherein said fuse retainer has a pair of fuse retainer-biasing coil spring;

wherein said pair of fuse retainer-biasing coil springs sit axially in said fuse retainer-receiving blind slot in said fuse-holding disc;

wherein said pair of fuse retainer-biasing coil springs straddle said pin-receiving through bore in said fuse-holding disc;

wherein said pair of fuse retainer-biasing coil springs bias against said fuse holding disc-facing front surface of said base of said fuse retainer; and wherein said pair of fuse retainer-biasing coil springs urge outwardly said base of said fuse retainer so as to allow the fuse and/or said fuse eliminator/adapter to be pressed into electrical communication with said four electrical contacts of said electrical contact disc, respectively, which then press against said pair of proximal electrical contacts and said pair of distal electrical contacts of said housing, respectively.

45. The switch as defined in claim 43, wherein said fuse retainer has a pair of fuse-engaging legs;

wherein said pair of fuse-engaging legs are L-shaped;

wherein said of fuse-engaging legs extend from said electrical contact disc-facing rear surface of said base of said fuse retainer;

wherein said pair of fuse-engaging legs straddle said pin-receiving through bore in said base; and wherein said pair of fuse-engaging legs hold a large fuse and/or said fuse eliminator/adapter, depending upon whether the larger fuse is used and/or if at least one of the fuses used is a small fuse.

* * * * *